US005746431A

United States Patent [19]

McIntyre et al.

[11] Patent Number: 5,746,431

[45] Date of Patent: May 5, 1998

[54] QUESTION AND ANSWER FOOTBALL GAME

[76] Inventors: Martin D. McIntyre, 13 Yorkshire Dr., Greenville, S.C. 29615; Jerry L. McLendon, 6437 Shady La., Mobile, Ala. 36695

[21] Appl. No.: 645,430

[22] Filed: May 13, 1996

[51] Int. Cl.[6] ..... A63F 7/06

[52] U.S. Cl. ..... 273/247; 273/298; 273/430; 273/277

[58] Field of Search ..... 273/55 R, 85 R, 273/87 F, 93 C, 94, 247, 244, 277, 296, 298, 302, 429, 430, 431, 432

[56] References Cited

U.S. PATENT DOCUMENTS

| | | | |
|---|---|---|---|
| 2,060,973 | 11/1936 | Brown, Jr. et al. | 273/152 |
| 2,064,466 | 12/1936 | Downey | 273/152 |
| 2,106,846 | 2/1938 | Katz | 273/152 |
| 3,143,348 | 8/1964 | Carsen et al. | 273/296 |
| 3,492,000 | 1/1970 | Board | 273/134 |
| 3,730,528 | 5/1973 | Corrado . | |
| 4,706,959 | 11/1987 | Price | 273/247 |
| 4,773,650 | 9/1988 | Doughty | 273/247 |
| 4,856,780 | 8/1989 | Begley et al. | 273/244 |
| 5,087,051 | 2/1992 | LoBue | 273/247 |
| 5,186,467 | 2/1993 | Chasin | 273/298 |
| 5,403,013 | 4/1995 | Gilbert | 273/298 |
| 5,441,277 | 8/1995 | Lenhart et al. | 273/432 |
| 5,501,456 | 3/1996 | Collins et al. | 273/430 |

OTHER PUBLICATIONS

Reader's Digest, Book of 1000 family Games, "Blackboard Football", pp. 102, 1973.

*Primary Examiner*—William M. Pierce
*Attorney, Agent, or Firm*—Cort Flint

[57] ABSTRACT

A question and answer football board game is disclosed which provides a complete game for individual institutions and/or teams. Players compete by answering questions which are inscribed on play cards (14) which are divided into categories according to progressive levels of difficulty. The game can be played by one individual, two individuals, or two groups of individuals. The game may be played using data from one or two institutions. A score card (20) is used by the offensive player to record the results of each play attempted, the outcome, points scored and total score. The defensive player reads questions from cards drawn from the 4 categories requested by the offensive player or team. More difficult questions are worth more yards gained. Kick cards (12) are used for punt, kick off, field goal, and extra point attempts. A team marker (16) is placed on a game board (22) which resembles a football field provides yard markers (24) for visual reference of player progress. As points are scored they are tabulated on score card (20). The game follows standard football rules and conventions. Kick cards (12), and play cards (14), are arranged in a game box 10.

8 Claims, 4 Drawing Sheets

20

| DOWN | YARDS TO GO | BALL ON | ATTEMPT | GAIN | POINTS | SCORE |
|---|---|---|---|---|---|---|
| 1 | 10 | 20 | 5 | 3 | | |

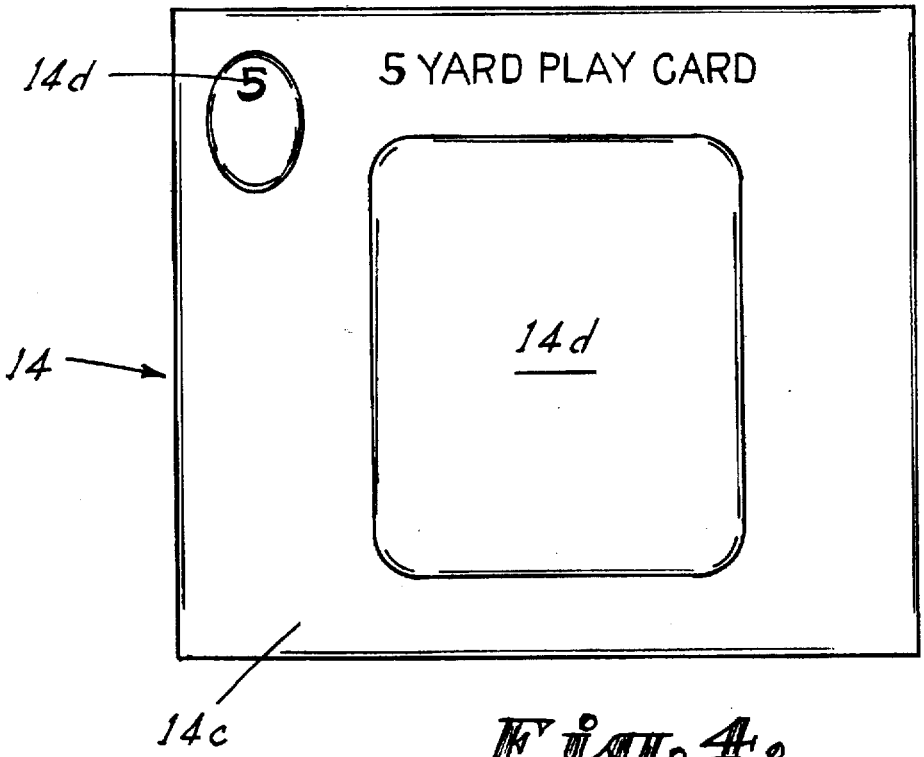
Fig. 4.
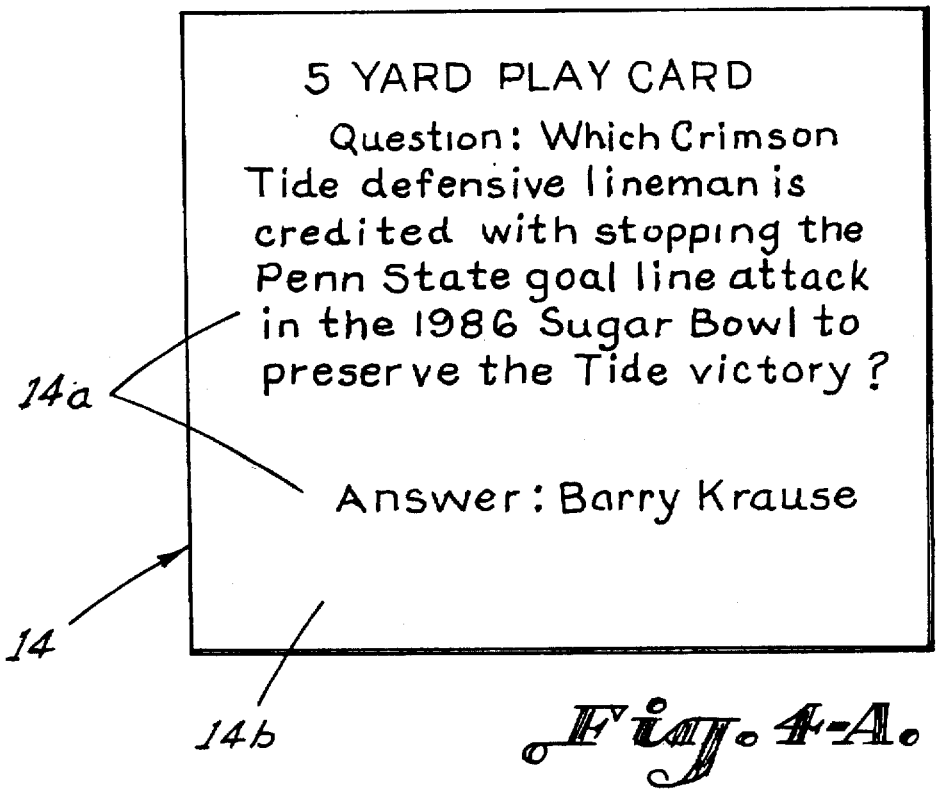
Fig. 4-A.

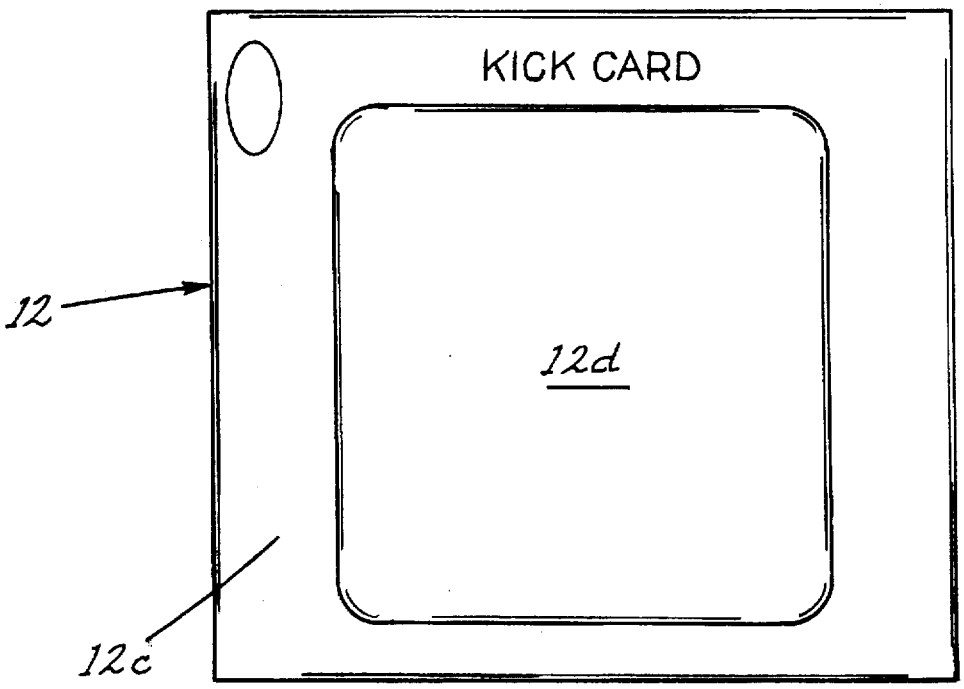
Fig. 5.
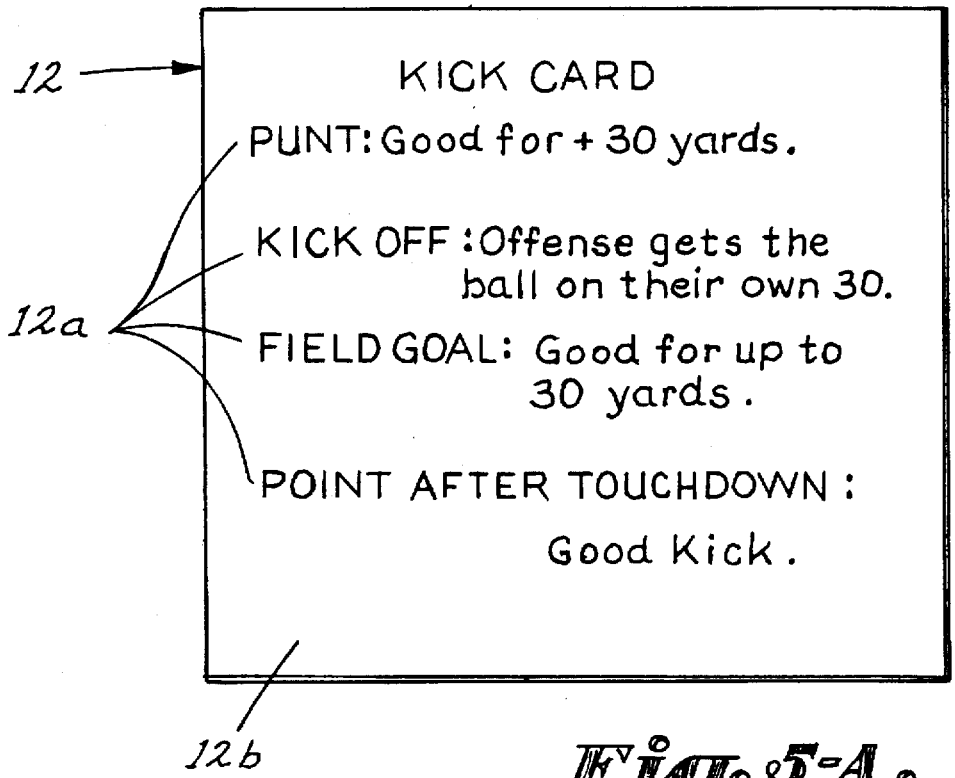
Fig. 5-A.

QUESTION AND ANSWER FOOTBALL GAME

BACKGROUND—FIELD OF INVENTION

This invention relates to an entertainment game, and, more particularly, to a question-and-answer football game based upon football facts and personalities at individual institutions, wherein players may compete using knowledge about separate institutions, or the same institution, and advance toward a goal by answering questions correctly.

As the popularity of sports grows, so grows the sophistication of fans in their knowledge about matters concerning their favorite teams. Fans take pride in their knowledge of the history, exploits and personalities of their favorite teams. Fans have no board game which allows followers of different institutions to face off with each other and compete. Board games which represent sports such as football are generally applicable to the entire scope of all teams, or institutions, or they are games of chance where a probability device such as a die, spinner or card is used to create an event. Many sport games have been developed, but these games do not illustrate and teach the history of a particular institution.

The prior art games are complicated because of the use of various methods of probability devices such as a die or spinner, sometimes in concert with a card drawn from a deck of cards which specify various outcomes. Game complexity constitutes a problem for the successful introduction of an entertainment game.

Further, the prior art games have lacked a suitable feature that allows a group of people to play in a setting such as a sport weekend gathering where those present are divided in their loyalty to the teams represented. A deficiency of some games stems from the fact that no flexibility exists for those less skilled to contend against those more skilled at the art of the game.

Various forms of football games have been heretofore provided in the art. For example, U.S. Pat. No. 2,060,973, describes a rather complicated football amusement game which is played with three decks of cards. The major part of the game operation consists of opposing players making a choice by selecting one card to represent one play of the game. The two opposing players' cards are slotted and juxtaposed to determine the outcome of the play. By reading through the slot opening in one card, the imprint on the opposing card is visible. At the end of an unsuccessful series of attempts, the ball is given over to the opposing player. Also when this occurs, players exchange decks of cards to allow for the offensive and defensive teams to change. No questions or answers are used to rule the success or failure of the players. In U.S. Pat. No. 2,064,466, a game is described which uses cards on which have been inscribed details of a football play. Cards are placed face down in divisions of "punts", "pass", and "scrimmage". Selection of cards by players of the game is made according to judgment of what is believed to be the best play to attempt. The card describes what event is to occur. For example, "Break through right tackle—7 yard gain", and the players move the play indicator to the proper position on the play surface. There is no provision for exchange of historical or factual information, nor may the players use different data. There is no provision for levels-of-difficulty being rewarded by proportional gains. U.S. Pat. No. 2,106,846, Katz describes a game somewhat similar to that previously described. Cards are used which have inscribed information that describes a football play or similar event that could be expected to occur in an actual football game. Players draw six cards to determine circumstances for the kickoff and ensuing play. Game progress is made based upon numerals inscribed on cards being added, and upon the event inscribed on the face of the cards. No provision for exchange of educational or factual information is mentioned in this art. In U.S. Pat. No. 3,022,068, a football game is described where the board surface does not simulate a football field, and the offense and defense team are not lined up and moved as a group. U.S. Pat. No. 3,492,000, reveals a football board game with cards having various characters printed in a variety of positions, and apertures. One player selects a play card. The other player selects his choice of cards, and the two are superimposed to determine an outcome depending on the results of overlying apertures. The game is primarily one of chance and strategy rather than knowledge. It is not oriented toward any given team or institution.

U.S. Pat. No. 4,773,650, discloses a relatively sophisticated football board game simulating a professional football game. In the operation of the game five stacks of cards are used to direct the progress of the game. Opposing players draw a card each which, when combined, result in a particular outcome. To introduce the element of chance a spinner is used to arrive at a random number within a range of numbers which by reference to a chart and in combination with a selection of a particular chart, or a particular play among a group of plays on such chart, produces a result. In U.S. Pat. No. 5,087,051, a quiz football board game is disclosed having a plurality of football question and answer cards, a game board and means to represent the opposing teams and a pair of card holders. The game board has spaces for numerous game pieces to move around the periphery of the board and land on spaces which allow the play to advance or regress. This game is complex, using player pieces, penalty cards, question cards, and die. The question cards are provided in one version only. In U.S. Pat. No. 5,221,084, a game is described which uses a mixture of player pieces which can be arranged to resemble the location and set-up of players in an actual game. The sport surface of the game board is marked in a grid pattern. Individual set pieces contend against each other.

A publication entitled, "Book of 1000 Family Games" by Readers Digest, (1971) lists "Blackboard Football" on page 102. This game is described as an informal game in which a team leader writes questions on slips of paper for players to answer. The use of questions in 3 levels is described. Simple problems are worth 10 yards, moderate questions 20, and difficult problems are worth 30 yards. A likeness of a football field is drawn on a blackboard. The ball is started on the fifty yard line, and players have 3 attempts to score before turning of the game over to the opposition. There is no prepared data in the game. The subject matter is not limited to football lore or history. It is instead used as a means of keeping score for players who contend on any topic.

In U.S. Pat. No. 4,856,780, a board game is described which has the form of a basketball game. Five different colored pairs of tokens are used for two purposes. One token is used to track the players' progress around the board, and the second is used to keep score. Players advance their tokens according to the outcome of a roll of dice, the particular square on which the piece lands, and whether the player answers a question correctly. Colored cubes with indicia inscribed upon them are used to correlate to one of several questions on cards. The playing board has a perimeter of squares and a center composed of basketball images. In U.S. Pat. No. 5,186,467, a game is described the subject of which is baseball. Two decks of cards are used by players to attempt to match a famous team and player's uniform numbers to achieve a correct combination. A combination of two correct cards is needed for a player to progress.

Accordingly, an object of the present invention is to provide a competitive game where the players knowledge of a team is matched against an opponent whose knowledge of a different team, or the same team's history, achievements and personalities determines the winner.

Another object of the invention is to provide a competitive game that results from persons being exposed to interesting facts, and accomplishments from an institution other than their own.

Another object is the enhancement of enjoyment surrounding sports events such as, but not limited to, weekend football games where people enjoy the spirit of support for the favorite team.

Another object of the invention is to provide a competitive game wherein learning can occur between sports fans of all ages. A youngster with an interest in a college football team can be matched, with a much more experienced person who enjoys exhibiting similar knowledge about a professional football team. Without artificial advantages or handicapping, the youngster and the adult can be evenly matched because of knowledge of his chosen team's history.

Another object of the present invention is to provide an football entertainment game in which sports fans whom cannot participate in a real game because of physical limitations, or other reasons, may participate and demonstrate prowess by successfully demonstrating mental power through knowledge of sport team facts, records, etc.

Still another object of the present invention is to provide a football entertainment game in which the physical and structural characteristics of a football board game are simplified while retaining the excitement of challenge in good-natured competition.

Advantageously, the game of the present invention may be played in multiple ways. For example,one person may play using data from one team, or two people may play using data from one team. Two persons may play using data from different teams. Two groups may play using data from one team, or using data from different teams. The prior art games are typically played according to one set pattern of play.

DESCRIPTION OF THE DRAWINGS

FIG. 4 is a plan view of the play card back according to an embodiment of the present invention;

FIG. 4A is a plan view of a play card front according to an embodiment of the present invention;

FIG. 5 is a plan view of a kick card front according to an embodiment of the present invention; and FIG. 5A is a plan view of the kick card back according to an embodiment of the present invention.

SUMMARY OF THE INVENTION

Figure 1:
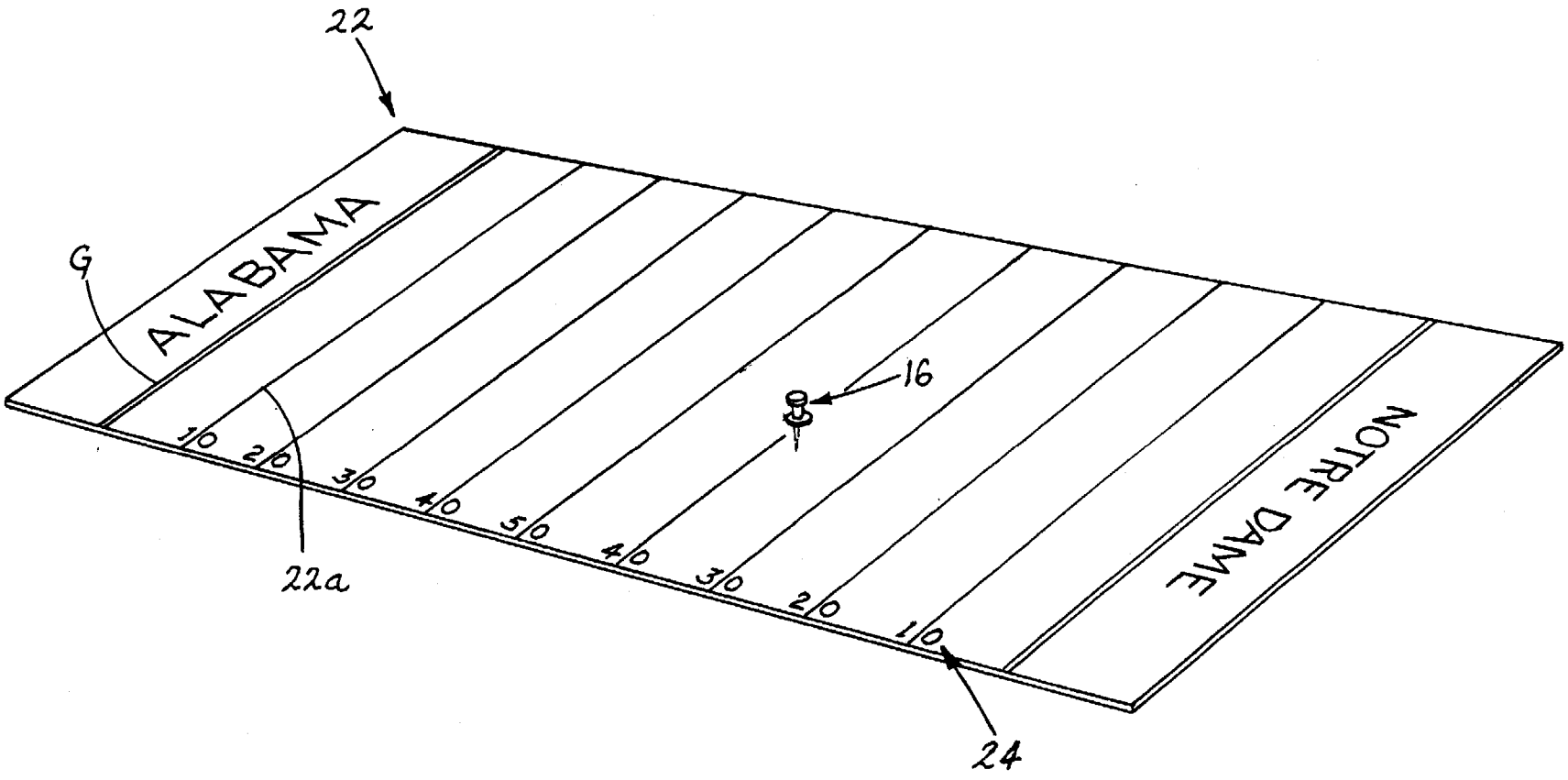
FIG. 1 is a perspective view illustrating a gameboard and entertainment football game according to an embodiment of the present invention.

The above objectives are accomplished according to the invention by providing an educational football game for testing a player's knowledge of factual sports information regarding a particular institution comprising a plurality of playing cards marked with progressive levels of yardage gain and a written question embodied on each playing card pertaining to factual football information at a particular institution, the question having a degree of difficulty corresponding to the progressive levels of yardage gained. The educational football game further comprises a written answer embodied on each playing card responsive to the question embodied on the playing card, a plurality of kick cards which include a written kick instructions for at least one of a kick-off, punt, field goal, or point after touch down kick action, and a recording device for recording the play of the player according to standard football rules based on the yardage gained by answering the questions on the playing cards, and the kick instructions on the kick cards. The recording device includes a game board which represents a football field having ten-yard dividers and goal lines at opposing ends of the field, and a marker for indicating the location of the football in response to the progress of the player on the football field. The recording device further includes a score card which is categorized for indicating the present position of the player, the play attempted by the player from the present position, and the results of the attempted play. The score card includes columns with headings for indicating the number of the down, yards to go for a first down, the yard line on which the ball is located, the attempted level of yardage gained or kick action by the player, the yardage gain made by the player, any points obtained, and a cumulative score total. The recording device further includes a score card which is categorized for indicating the present position of the player, the play attempted by the player from the present position, and the results of the attempted play. The score card includes columns with headings for indicating the number of the down, yards to go for a first down, the yard line on which the ball is located, the attempted action of the player in terms of the level of yardage gained or kick action, the yardage gain made by the player, any points obtained, and a cumulative score total. The written question and written answer are embodied on a first side of each of the playing cards. Each of the playing cards includes a second side having indicia representing the institution to which the questions and answers on the first side of the card pertain. The playing cards embody indicia representing the institution to which the questions and answers on the playing cards pertain. A container is included for the play and kick cards and includes a plurality of indexes for organizing the playing cards according to the level of yardage gained and difficulty level. A first set of the playing cards which embody factual information pertaining to a first institution and at least a second set of playing cards which embody factual information pertaining to a second institution.

An educational football game for testing a player's knowledge of factual sports information regarding a particular institution comprising a plurality of playing cards marked with progressive levels of yardage gain, a written question embodied on each playing card pertaining to factual football information at a particular institution, the question having a degree of difficulty corresponding to the progressive levels of yardage gained, a written answer embodied on each playing card responsive to the question embodied on the playing card, and a plurality of kick cards which include a written kick instructions for at least one of a kick-off, punt, field goal, or point after touch down kick action. The playing cards and kick cards are drawn for a player and the play of the player is monitored according to standard football rules based on the yardage gained by answering the questions on the playing cards, and the kick instructions on the kick cards. A recording device is provided which includes a score card categorized for indicating the present position of the player, the play attempted by the player from the present position, and the results of the attempted play. The score card includes columns with headings for indicating the number of the down, yards to go for a first down, the yard line on which the ball is located, the attempted level of yardage gained or kick action by the player, the yardage gain made by the player, any points obtained, and a cumulative score total. The recording device which includes a game board which represents a football field having ten-yard dividers and goal lines at opposing ends of the field, and a marker for indicating the location of the football in response to the progress of the player on the football field. The written question and written answer are embodied on a first side of each of the playing cards and the playing cards includes a second side having indicia representing the institution to which the questions and answers on the first side of the card pertain. A first set of playing cards which embody factual information pertaining to a first institution. A second set of playing cards which embody factual information pertaining to either the first institution or a second institution may also be utilized. A container is included for containing play and kick cards and includes a plurality of indexes for organizing the playing cards according to the level of yardage gained and difficulty level.

A method of playing an educational sports game based on a player's knowledge of factual sports information about a sports team including providing a plurality of playing cards having indicia of progressive levels of advancement in regards to reaching an objective of the game wherein each the playing card includes a written question about the factual information pertaining to a particular sports team and a written answer responsive to the question wherein the questions have degrees of difficulty corresponding to the progressive levels of advancement, selecting the playing cards in accordance with a desired level of advancement, and monitoring the advancement of the player toward the game objective in response to the correctness of the player's answer to the corresponding questions embodied on the playing cards.

The method of playing an educational football game based on a player's knowledge of factual sports information regarding a particular team including at least one set of playing cards having indicia of progressive levels of yardage gained indicated on the cards wherein written questions are embodied on each of the cards and the degree of difficulty of the question corresponds to the progressive level of yardage gained indicated on the cards, and wherein a written answer to the question is embodied on each of the cards, selecting the cards according to a player's desired level of difficulty and yardage gain, recording the position of the player relative to a football field prior to selecting the card, awarding the yardage gained by the player depending on the correctness of the player's answer to the question on the selected card, and monitoring points made by the player in accordance with standard football rules, and recording the points of the player. A set of kick cards is provided which include various kick instructions corresponding to conventional kick actions which occur in a football game; and wherein the player draws one of the kick cards in response to failing to achieve a first down or touchdown following a completion of a third down play. A replica of a football field and a marker for indicating the location of the football on the football field corresponding to the progress of the player are provided. Possession of the football is turned over to a second player in response to the kick instructions on the kick card as drawn by a first player whereby the second player resumes play of the game in accordance with the draw of the playing cards and the answering of the questions until the second player either fails to achieve a first down or score a touchdown.

An alternative method includes the steps of providing a second set of playing cards having written questions embodied on the cards corresponding to progressive levels of yardage gained and degrees of difficulty pertaining to a second institution, and wherein answers to the questions are embodied on the playing cards along with the questions; the first player selecting and answering the questions on the first set of cards, and the second player selecting answering the questions on the second set of cards.

The game is played in accordance with conventional football rules and includes recording a number of a down, the yards to go for a first down, and the present location of the football for a first player. The rules further include indicating the level of yardage gain attempted by the first player on the present down, selecting a playing card by the second player corresponding to the level of difficulty selected by the first player; the second player asking the question written on the playing card to the first player, the second player checking the answer of the first player against the answer written on the playing card, and recording any yardage gained by the first player in response to the correctness of his answer to the question.

One distinction of the present game from the prior art resides in the following: information for the game data in the invented game is from a particular team's history, facts, and achievements. Now, for the first time, people can play each other using data from either a particular team or separate teams in a question and answer football game. A further distinction is the division of game questions into levels of difficulty to accommodate those less skilled in the art. A players knowledge of the facts and accomplishments of his team can be rehearsed and studied prior to a contest. The game can be an educational exchange of information. The game relies on no die, spinner or similar device to cause chance developments or unpredictable outcomes. Success or failure comes as a result of players demonstrating knowledge of a team's history and accomplishments. Simplicity rather than complexity has been observed in the invented game's design in order to make it enjoyable for team supporters, regardless of age.

DESCRIPTION OF A PREFERRED EMBODIMENT

Referring now in more detail to the drawings, an entertainment game is illustrated in FIG. 1 which, in the preferred embodiment, is in the form of a football game comprising a game board 22 in the configuration of a miniature simulated football playing field. The playing field has lateral yard lines 22*a* which represent the ten yard lines which are marked on an actual football playing field at 10 yard intervals and goal lines which establish the point at which a touchdown may be declared. Yard markers 24, corresponding to the yard lines appear along longitudinal margin of game board 22, for player reference.

Team marker 16, as shown in FIG. 1, may be colored to represent that color of whichever institutions are being represented in the game. A rules book 18 provides written instructions regarding how the foregoing game components are used to play the game. A score card 20, shown in FIG.

Figures 2, 3:
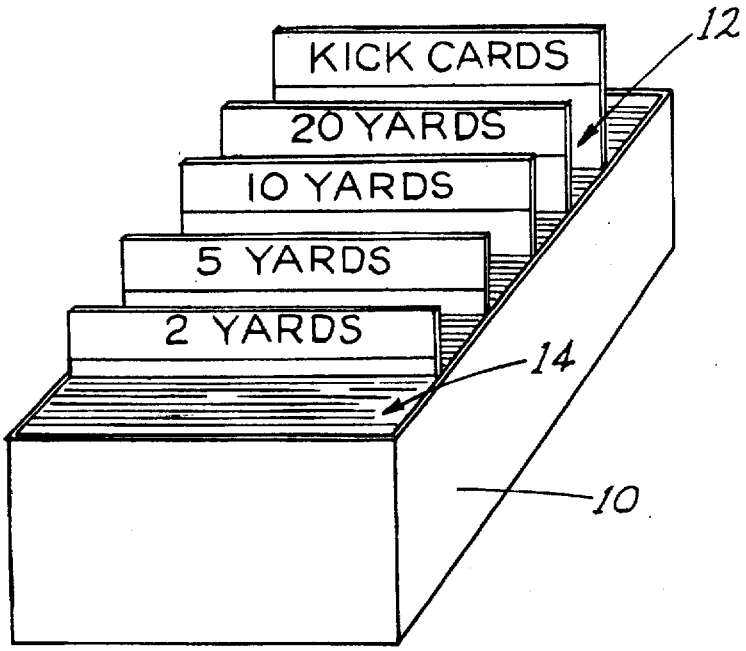
FIG. 2 is a perspective view of play cards and kick cards in the game box according to an embodiment of the present invention.
FIG. 3 is a plan view of the play book according to an embodiment of the present invention.

3, provides a means for tabulating plays, as well as the points scored and the total points accumulated by players. There is a plurality of play cards 14, as shown in FIGS. 2 and 4, 4A, include indica 14*a* in the form of a printed question and correct answer to the question on a first, back side 14*b*. Opposite, second sides 14*c*, called the front side of play cards 14, may include indicia such as decorations and/or identifications (e.g. logos) of the institution represented and further to include a numeral at 14*d* which establishes the category and level of play and advancement the play card belongs to. In the illustrated embodiment, numerals 2, 5 (FIG. 4), 10, or 20 are used to provide visual indication as to the level of play and advancement the card belongs to. Preferably, play cards 14 are organized in a box 10 and indexed according to their level of play, as can best be seen in FIG. 7, so that the players may easily select a card depending on their desired level of play.

There is a plurality of kick cards 12, shown in FIGS. 5 and 5A, having indicia 12*a* provided on a back side 12*b* in the form of printing which indicates written outcomes of the various forms of kicks which are used in the game which include kick-off, punt, field goal, and point-after-touchdown. Opposite sides 12*c*, referred to as the front side of the kick cards include suitable indicia as to distinguish kick cards 12 from play cards 14. The fronts of cards 12 may also include indicia at 12*d* to reflect attributes, or other identifications or logos of the institution represented.

OPERATION

The preferred embodiment of operation begins with the players choosing whether to play the game with one common set of data, or with each player using separate data. An example of the former occurs when two football fans of the University of Alabama use the game apparatus from the Alabama football game to play each other. This mode of play is similar to most other board games. An example of the latter occurs when a fan of the University of Notre Dame uses his data cards from the Notre Dame apparatus to play against a Dallas Cowboys fan who uses his data cards from the Dallas Cowboys apparatus. As in an actual game, it makes no difference which players field is used. The field layout, and the rules are universally accepted. The game can be supplied with sets of play cards and data for desired institutions and teams in a particular market area. The number of play cards and data sets supplied with the game may also vary as desired.

To begin with, the players determine which will be the offensive team first. Players may consult rules book 18, for guidance on how to proceed at any time during game. One rules book 18 serves for all players of game. As in football, the goal of the game is to score the most points. Standard football rules of the NCAA may be used. It is played as much as possible like actual football. For example, each player has 4 tries to move his team 10 yards. Touchdowns are scored at 6 points. Field goals are scored at 3 points. A point after touchdown gains one point. If a player wishes to attempt a two yard conversion after a touchdown, the kick card is not used. Instead, a two yard play card 14, is used. Cards are always drawn from the front of the section or category and returned to the back of that section or category.

Kick Off

For the kick-off, the offensive player asks the defensive player for a kick card 12. The defensive player takes front card from kick card section or category. Defensive player reads aloud for offensive player to hear, entry on kick card 12, beside words, "Kick-Off". Offensive player then moves team marker 16, to position as designated by kick card 12.

First Down

For the first down, the offensive player writes numeral 1, under column headed, " Down", in score card 20. The offensive player writes numerals 10 under column headed, "Yards To Go", in score card 20. The offensive player then writes numerals to indicate which yard marker 24, the ball is resting at under column headed, "Ball On", in score card 20.

The offensive player determines which level of difficulty to attempt. The more difficult questions will provide greater yardage gains that less difficult questions. Play cards 14, are then placed in categories "2 Yards", "5 Yards", "10 Yards", and "20 Yards" according to the numerals printed on front and back of play cards 14.

If the answer is incorrect, there is no yardage gain and second down play begins as described below. The offensive player writes the numerals, "2", "5", "10", "2 ", or the word, "kick" in a column headed, "Attempt" on score card 20. The offensive player asks the defensive player to read a question from play card 14. The defensive player will choose the question from whichever level of difficulty category has been selected.

The defensive player then takes the front card from the proper section or category. The defensive player reads aloud for the offensive player to hear, the entry on play card 14. The defensive player observes the time and allows 30 seconds for the offensive player to answer the question correctly. If the offensive player answers correctly within thirty seconds, the team marker 16 is moved toward the defensive players goal, the number of yards indicated on play card 14. The Play cards 14 are placed in categories "2 Yards", "5 Yards", "10 Yards", and "20 Yards" according to the numerals printed on front and back of play cards 14.

If the answer is incorrect, there is no yardage gain and second down play begins as described below. If the answer is correct, the offensive player writes numerals "2", "5", "10", or "20" under column headed, "Gain" on score card 20. If the yardage gained is equal to, or greater than the yardage needed to reach the defensive player's goal line, a touchdown is declared and the numeral "G" is entered in column headed "Points". Next, six points are added to the previous cumulative total in column "Score" and the new total score is written in "Score" column.

If the yardage gained is less than that needed to reach the goal line, or first down, or first down, the offensive player subtracts the amount gained from "ten" and declares that it is now second down and the amount of the calculation's remainder to go for a first down. If the yardage gained on the play is greater than that needed for a first down, but less than that needed for a touchdown, the ball is advanced to the new yardage gain position, and located there for a new first down. Play resumes as just described. However, if the yardage gained is less than that needed for a first down or a touchdown, second down play begins.

Second Down

The offensive player writes the numeral "2" under a column headed, "Down", in score card 20. The offensive player subtracts the yardage gained from "ten" and writes the remainder in the "Yards To Go", column in score card 20, to indicate the yards remaining for a first down. The offensive player writes the position of the marker as referenced to yard marker 24 in the column headed, "Ball On".

The offensive player determines which level of difficulty to attempt, knowing that more difficult questions provide greater yardage gains that less difficult questions. Play cards 14, are placed in categories of "2 Yards", "5 Yards", "10 Yards", and "20 Yards" according to the numerals printed on front and back of play cards 14.

The offensive player writes numerals, "2", "5", "10", "20", or the word, "kick", in column headed, "Attempt" in score card 20. Offensive player asks defensive player to read a question from play card 14, from whichever level of difficulty category he or she selected.

Defensive player takes front card from section or category. Defensive player reads aloud for offensive player to hear, entry on play card 14, and returns card to back of section.

Defensive player observes time and allows 30 seconds for offensive player to answer question correctly. If offensive player answers correctly within thirty seconds the team marker 16, is moved toward defensive players goal the number of yards indicated on play card 14.

If the answer is incorrect, third down play begins as described below. If the answer is correct, offensive player writes numerals 2, 5, 10, or 20 under column headed, "Gained" on score card 20. If the yardage gained is equal to, or greater than the yardage needed to reach the defensive players goal line, a touchdown is declared and the numeral "6" is entered in column headed "Points". The 6 points are added to the previous cumulative total in column "Score" and the new total score is written in "Score" column. If the yardage gained is less than that needed for a touchdown, but is sufficient for a first down, first down play resumes as described previously. If the yardage gained is insufficient for either a first down or touchdown, third down play begins.

Third Down

The offensive player writes the numeral "3", under a column headed "Down", in score card 20. The offensive player subtracts the number of yards gained from the number of yards needed for a first down and writes the remainder number in the column headed "Yards To Go", in score card 20 to indicate yards remaining for a first down. The offensive player writes in a column headed, "Ball On", the position of the marker as referenced to yard marker 24.

The offensive player determines which level of difficulty to attempt, knowing that more difficult questions provide greater yardage gains that less difficult questions. Play cards 14, are placed in categories "2 Yards", "5 Yards", "10 Yards", and "20 Yards" according to the numerals printed on front and back of play cards 14.

The offensive player writes the numerals, "2", "5", "10", "20", or words, "punt" or "field goal", in the column headed, "Attempt" in score card 20. The offensive player asks the defensive player to read a question from play card 14, from whichever level of difficulty category has been selected.

The defensive player takes the front card from that section or category. The defensive player reads aloud for the offensive player to hear, an entry on play card 14, and returns the card to the back of that section.

The defensive player observes time and allows 30 seconds for the offensive player to answer the question correctly. If the offensive player answers correctly within thirty seconds, the team marker 16 is moved toward the defensive player's goal the number of yards indicated on play card 14.

If the answer is incorrect, fourth down play begins as described below. If the answer is correct, the offensive player writes the numeral "2", "5", "10", or "20" under the column headed, "Made" on score card 20. If the yardage gained is equal to or greater than the yardage needed to reach the defensive player's goal line, a touchdown is declared and the numeral "G" is entered in the column headed "Points". The six points are added to the previous cumulative total in the "Score" column and the new total score is written in "Score" column. If the yardage gained is less than that needed for a touchdown, but is sufficient for a first down, first down play resumes as described previously. If the yardage gained is insufficient for either a first down or touchdown, fourth down play begins.

Fourth Down

The offensive player writes the numeral "4" under the column headed "Down", in score card 20. The offensive player subtracts the yards gained from the yards needed and writes the remainder in the "Yards To Go" column in score card 20, to indicate yards remaining for a first down. The offensive player writes in the column headed "Ball On", the position of the marker as referenced to yard marker 24.

The offensive player determines which level of difficulty to attempt, knowing that more difficult questions provide greater yardage gains that less difficult questions. Play cards 14 are placed in categories "2 Yards", "5 Yards", "10 Yards", and "20 Yards" according to the numerals printed on front and back of play cards 14.

Offensive player writes numerals, "2", "5" "10" "20" or words, "punt", or "field goal", in column headed "Attempt" in score card 20. The offensive player asks the defensive player to read a question from play card 14 or kick information from kick card 16, whichever is chosen.

The defensive player takes the front card from section or category selected. The defensive player reads aloud for the offensive player to hear, an entry on play card 14 and returns that card to back of the section.

The Defensive player observes time and allows 30 seconds for the offensive player to answer the question correctly. If the offensive player answers correctly within thirty seconds, the team marker 16 is moved toward defensive players goal the number of yards indicated on play card 14.

If the answer is correct, the offensive player writes the numeral "2", "5", "10", or "20" under the column headed "Made" on score card 20. If the yardage gained is equal to, or greater than the yardage needed to reach the defensive players goal line, a touchdown is declared and the numeral "G" is entered in column headed "Points". The six points are added to the previous cumulative total in "Score" column and the new total score is written in "Score" column.

Incorrect Answer on Fourth Down

If the offensive team answers incorrectly, and has failed to gain 10 yards in four tries, the offensive team gives up. The offensive player becomes the defensive player and defensive player or team becomes offensive player or team.

Punt or Field Goal

When the offensive player wishes to try a field goal or to punt on the fourth down play, that player makes the entry, "punt", or the entry, "field goal", in the column headed, "Attempt", and asks the defensive player for a kick card 12. The defensive player takes the front card from the front of kick card 12 section or category. If the offensive player has asked for a punt, the entry written next to the word, "punt", on kick card 12, is read aloud to the offensive player. The game continues according to the instructions worked out on the kick cards, e.g. the defensive team receives the ball on their 30 yard line and begins offensive first down play. If offensive player has asked for a field goal, the entry written next to the words, field goal, on kick card 12 is read aloud to the offensive player, and play or points carried out accordingly.

Point After Touchdown

When a touchdown is declared, the offensive team is entitled to a choice between an attempt for a "point-after-touchdown", or a "two point conversion". The offensive player advises the defensive player of the choice. If the choice is "point-after-touchdown", the defensive player selects the front card from kick cards 12 and reads aloud the entry written adjacent to the words, "point after touchdown" to the offensive player.

If the yardage gained is less than that needed to reach the goal, the offensive player subtracts the amount gained from ten and declares that it is now second down and the amount of the calculation's remainder to go for a first down.

Two-Point Conversion

If offensive player has asked for a two point conversion after a touchdown, the defensive player does not use a kick card. Instead of a kick card 12, the defensive player takes the front play card from the "two-yard" category and reads the question aloud for the offensive player to answer.

The time limit is 30 seconds. If the offensive player answers correctly, the offensive player is granted 2 points. If the answer is incorrect, the offensive team or player, must perform a kick-off.

Accordingly, it can be seen that a highly educational and challenging game can provide for especially satisfying activities for those persons who favor an institution and who closely follow the exploits of its football program. The entertainment afforded by the game can be enjoyed in unlimited settings because of the game's flexibility in arranging for various numbers of players. The game also accommodates people of different institutional loyalty. Because players can use different data cards, the game is new and unique each time. A further element of uniqueness is the simple design of the game. Because play takes the form of a football game, universal football rules and conventions are followed. This means that people who understand the basic concepts of a football game can quickly become familiar with this game. This game has unlimited combinations of teams and numbers of players that may participate. Having an educational nature, the game offers an opportunity for learning and a sense of achievement for those who become proficient in the data that makes up the game. It is attractive to players of all ages and can serve as a family game.

Thus, it can be seen that this game overcomes the problems of existing games. The first problem being that fans and supporters of different teams can now face each other on a simulated football field and contend against each other using their knowledge for the first time. This game is simple. Normal football rules and conventions are followed. People do not have to learn a new system in order to play. The game is informative and educational for its players. Rather than a game of chance, this is a game of knowledge. Participants become efficient by becoming familiar with their favorite team's players, accomplishments and history.

Players of practically all ages may play this game. Various other embodiments and ramifications are possible within its scope. For example, basketball can become the subject matter for this game concept just as football has been dealt with here. This is also true of professional baseball. Thus the scope of the invention should be determined by the appended claims and their legal equivalents, rather than by the examples given.

What is claimed is:

1. A method of playing an educational, question and answer sports game based on a player's knowledge of factual sports information about a sport or an institution comprising:

providing at least one set of cards including a plurality of playing cards having indicia representing progressive numerical levels of advancement representing yards advanced in regards to reaching an objective of said game wherein each said playing card includes a written question corresponding to said indicia representing the progressive numerical levels of advancement representing yards advanced, and said written question being about factual information pertaining to a particular sports team and a written answer responsive to said written question wherein said written questions have degrees of difficulty corresponding to said progressive numerical levels of advancement;

selecting said playing cards by a respective player in accordance with a level of advancement desired to be achieved by the player;

answering the question by the player;

monitoring an answer by the player and an advancement of said player toward said game objective in response to whether said player's answer to said corresponding questions embodied on said playing cards is correct;

repeatedly selecting said playing cards and adding the numerical levels of advancement for correct answers until the player achieves a first down by advancing at least a total of ten yards in four or less selections of the playing cards or achieves a touchdown;

providing a set of kick cards which include kick instructions; and drawing one of said kick cards as an option after failing to achieve a total of at least ten yards in three or less selections of the playing cards.

2. The method of claim 1 including providing a set of kick cards which include various kick instructions corresponding to conventional kick actions which occur in a football game; and wherein said player draws one of said kick cards in response to failing to achieve a first down or touchdown following a completion of a third down play.

3. The method of claim 1 including providing a replica of a football field and indicating a location on said football field corresponding to the advancement of said player in yards.

4. The method of claim 1 including the step of turning over the selection of playing cards to a second player in accordance with said kick instructions on said kick card as drawn by a first player whereby said second player resumes play of the game in accordance with the selection of said playing cards and the answering of said questions until said second player either fails to achieve a first down by advancing at least a total of ten yards in four or less selections or scores a touchdown.

5. The method of claim 1 comprising providing a second set of playing cards having written questions embodied on said cards corresponding to progressive levels of yardage gained and degrees of difficulty pertaining to factual information about a second institution, and wherein answers to said questions are embodied on said playing cards along with said questions; said first player selecting and answering the questions on the first set of cards, and said second player selecting answering the questions on said second set of cards.

6. The method of claim 1 wherein said game includes:

recording a number of a down, a number of yards to go for a first down, and a present location of a football for a first player representing the advancement of the first player;

indicating the level of advancement yardage gain attempted by the first player on the present down;

selecting a playing card by said second player corresponding to the degree of difficulty selected by said first player; said second player asking the question written on said playing card to said first player;

said second player checking the answer of said first player against said answer written on said playing card; and recording any yardage gained by said first player in response to the correctness of his answer to said question.

7. The method of claim 1 including providing a formatted score card, and indicating a present position of the player, the play attempted by the player from the present position, and the results of the attempted play on the scorecard.

8. The method of claim 7 including indicating a number of a down, a number of yards to go for a first down, a yard line on which the ball is located, an attempted level of yardage gained or kick action by the player, a yardage gain made by the player, any points obtained, and a cumulative score total on said formatted score card.

* * * * *